US005775157A

United States Patent [19]

Caporusso et al.

[11] Patent Number: 5,775,157

[45] Date of Patent: Jul. 7, 1998

[54] SWINGING SELF-POSITIONING SUPPORT FOR PIPE BENDING MACHINES

[75] Inventors: Alessandro Caporusso; Mario Caporusso, both of Frosinone, Italy

[73] Assignee: C.M.L. Costruzioni Meccaniche Liri S.R.L., Frosinone, Italy

[21] Appl. No.: 764,750

[22] Filed: Dec. 12, 1996

[30] Foreign Application Priority Data

Dec. 15, 1995 [IT] Italy ..... RM95A0819

[51] Int. Cl.[6] ..... B21D 7/024

[52] U.S. Cl. ..... 72/321; 72/217; 72/150

[58] Field of Search ..... 72/149, 150, 157, 72/158, 388, 156, 217, 219, 320, 321

[56] References Cited

U.S. PATENT DOCUMENTS

| | | | |
|---|---|---|---|
| 847,094 | 3/1907 | Monnet et al. | 72/150 |
| 1,105,914 | 8/1914 | Miller | 72/150 |
| 1,462,315 | 7/1923 | Akey et al. | 72/217 |
| 1,600,339 | 9/1926 | Klarwasser | 72/321 |
| 1,662,428 | 3/1928 | Lowe | 72/150 |

FOREIGN PATENT DOCUMENTS

| | | |
|---|---|---|
| 0 364 836 | 4/1990 | European Pat. Off. . |
| 43 29 567 | 3/1995 | Germany . |
| 2 187 666 | 9/1987 | United Kingdom . |

*Primary Examiner*—Lowell A. Larson
*Attorney, Agent, or Firm*—Young & Thompson

[57] ABSTRACT

A pipe bending machine with a bending assembly (1) and a support arm (2), pivotedly supported swingingly relative to the bending assembly through a pivot (6) that is slidably supported along a stem (7) on the axis passing through the center of rotation of the matrix and the center of swinging of the countermatrix assembly (the "zero"), so as to automatically position and axis of the pipe on the zero.

5 Claims, 2 Drawing Sheets

SWINGING SELF-POSITIONING SUPPORT FOR PIPE BENDING MACHINES

BACKGROUND OF THE INVENTION

The present invention generally relates to pipe bending machines and the like, such as beam benders and ring benders.

More particularly, the present invention relates to pipe bending machines having a bending system with a rotary groove pulley matrix, a groove countermatrix and a shoulder integral with the matrix. As is known, the pipe is clamped between the matrix and the countermatrix within the grooves thereof, and dragged into rotation on the matrix by the shoulders against the countermatrix. The countermatrix assembly swings up to a position where the thrust forces of the matrix and of the countermatrix oppose each other on the pipe to be bent in the bend start step.

In present pipe bending machines with a swinging countermatrix system, the supporting of the pipe takes place on a stand or on a plane where the pipe rests. Alternatively the pipe is cantilevered between the matrix and the countermatrix, without any support, albeit with more difficulty in executing the bending operation. However, with these solutions it is not possible to mount a member for controlling the pipe in its shifting and rotation in the bending step, such as made by the mandrel that, on the contrary, is mounted on an arm for supporting the pipe in the systems of the type with a swinging countermatrix assembly, such as those to which the present invention relates, or to control the "zero" fixed point of the radial motion of the pipe and then of the: support.

A general object of the present invention is to provide, for a pipe bending machine of the aforesaid type, an arm for supporting the pipe, so as to be able to endow such a machine with a mandrel for guiding and controlling the pipe in a bending step. However, in the pipe bending machines of the type to which the: present invention relates, the bend start swinging of the countermatrix assembly results in a corresponding angular displacement of the pipe to be bent before reaching the true bending step. A particular object of the present invention is to provide a support: arm for such a type of machine that is able to follow such a swinging of the pipe in the bend start step with pivoting on the zero, and that, at the same time, is rigid and responsive to the motion of the pipe enough to maintain the required precision.

By"zero" it is meant herein the intersection of the axis of the pipe to be bent with the straight line through the centers of the rotation of the matrix and of the swinging of the countermatrix assembly.

Such an object is reached, according to the teaching of the present invention, by foreseeing for the pipe support arm EL swinging structure that pivots about this"zero".

The so configured machine, i.e. the machine which pivots; about the zero, allows in an absolute way not to vary the distance "x" between the zero point and the mandrel in the step of self-positioning of the swinging support. The fixed distance"x" is necessary to be able to predeterminate linear ledges of the mandrel for the execution of a piece according to a drawing. Moreover, as the swinging support pivoted on the axis through the zero slides on the perpendicular of the axis through the center of the matrix and the center of the swinging of the countermatrix, that condition allows one to leave the work field without removing the pipe from the machine to allow the substitution of the matrix with another one of a different radius as required by the drawing, without losing the heights preset on the linear and rotational axes.

With such a structure one has the advantage that a support arm goes to make up a mere means for supporting; it has not; to load itself with the forces that arise in the step of the start, of the bend, and a light structure can be foreseen for it. The machines made according to the teaching of the present invention, the performance being the same as those according to prior art of the rigid type, i.e. with a non-swinging countermatrix assembly and a support arm which is fixed in a rigid way, even if positionable, have a weight reduced from the order of quintals, to the order of tens of kilograms, in that the side contrast thrust in the step of bending in the swinging system is entirely supported by the swinging countermatrix assembly.

Following the swinging of the countermatrix assembly and the consequent one of the pipe axis, the support arm itself goes to position itself according to what will be the configuration of the machine in the true bend start step.

BRIEF DESCRIPTION OF THE DRAWINGS

The present invention will be best understood based upon the following detailed description of its preferred embodiment, given only as a matter of example, absolutely not of restriction, with reference to the accompanying drawings, wherein.

DESCRIPTION OF THE PREFERRED EMBODIMENTS

Figure 1:
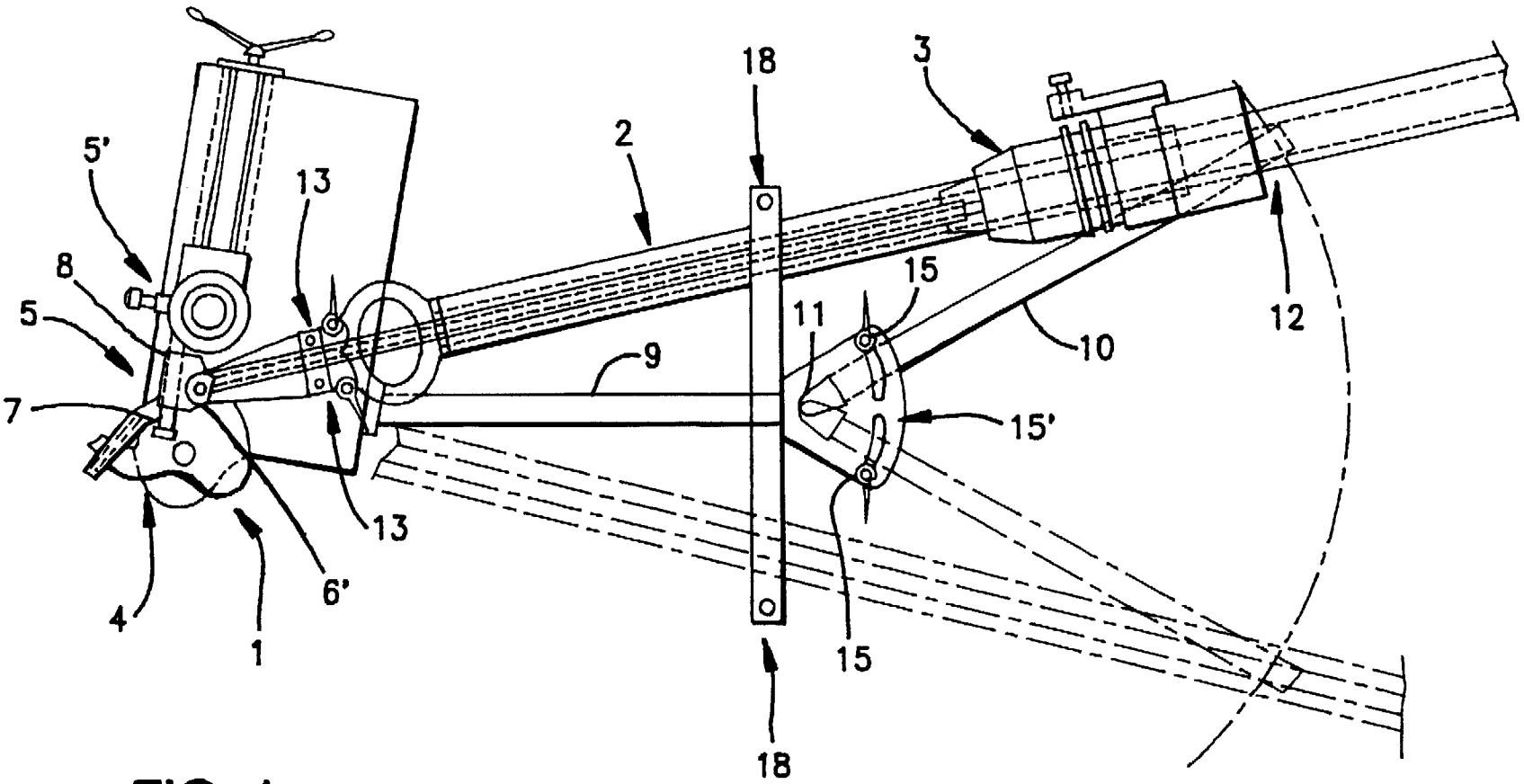
FIG. 1 is a top view.

A preferred embodiment of a pipe bending machine of the present invention comprises a bending assembly 1 and a pipe support arm 2, on which a mandrel 3 is positionable. The assembly :L comprises a shoulder groove pulley matrix 4 and a countermatrix 5.

The support arm 2 is articulated in a swinging way to the bending assembly 1 through a first pivot 6, which has its axis integral with the bending assembly and is cantilevered relative to the countermatrix 5 through a stem 7 that supports it by means of a block 8, whereunto the first pivot 6 is directly mounted. The stem 7 is ended beyond the block 8 by a circular ledge 7'. With this construction the pivot 6 always finds itself on the perpendicular of the axis through the center of the matrix-center of swinging of the countermatrix 5 and on the axis of the pipe under bending.

Therefore, and end of the support arm 2 is always pivoted on first pivot 6. Moreover, it is swingingly supported by two links 9, 10 connected with each other through second pivot 11 and to the support arm 2 with third pivot 12. The link 9 has an end connected to the machine body in a fixed way, for instance by means of bolts 17, and is supported on the ground through adjustable screws 18 for leveling. The function of this link 9 is to ensure stability to the machine and the length of the latter as a function of the length of the support arm 2.

With this constitution the support arm 2 is perfectly able to follow the swinging of bend start due to the swinging of the countermatrix 5.

The positioning of the first pivot 6 is a function of the bending radius one wants to impress to the pipe, i.e. of the radius of the matrix. A screw 5' can access the surface of the stem 7, screwing itself in a respective hollow, to fix the correct position of the sliding of the first pivot 6.

The aforesaid circular ledge 7' provides for avoiding the sliding of the block 8 out of the stem 7.

The construction is completed by rollers 13 shaped as a function of the pipe or beam to be guided and supported on both the vertical and the horizontal axes that are arranged at the pivoting end of the support arm 2, which rollers 13 are handle-adjustable as a function of the diameter of the pipe.

Figure 2:
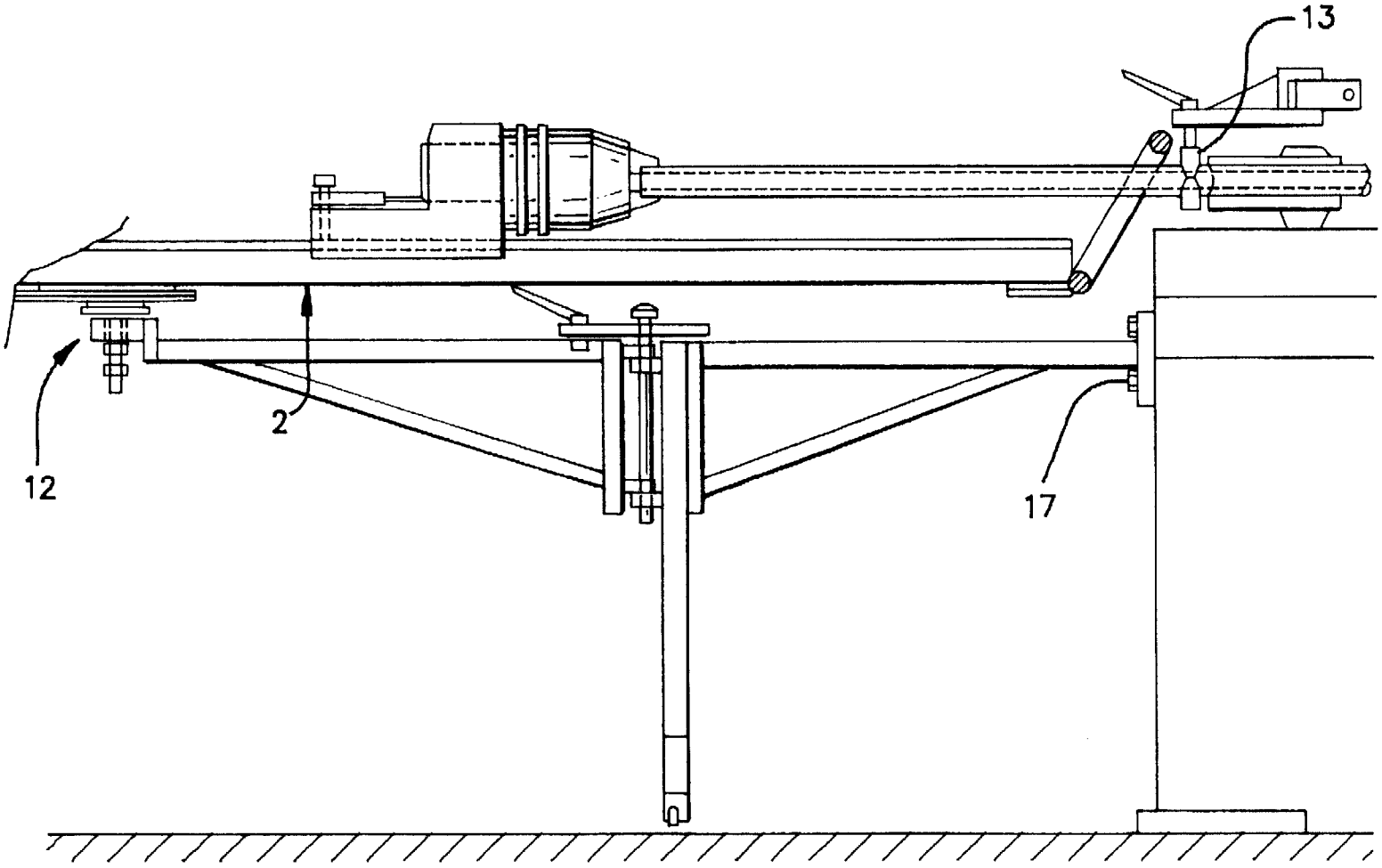
FIG. 2 is a side view of the pipe bending machine according to the present invention.

Moreover, the arm 2 is supported on the link 10 through the linear guide of rollers 16 (see FIG. 2), which render the pivoting motion on the third pivot 12 possible.

The swinging of the link 10 is restricted by the stops made up by rollers 15 that slide fixably in respective slots of a caliper 15', centered on the second pivot 11 to the end of restricting the idle stroke of said link.

The present invention has been described and depicted with reference to a preferred embodiment, but it is to be expressly understood that variations, additions and/or omissions can be made, without thereby departing from its teaching. Therefore, the protection scope remains only defined by the accompanying claims. For instance, the support arm could also be supported at the not pivoted end on a rolling wheel on the ground.

Still, the motion assembly 10-11-12 could be duplicated., tripled or generally multiplied to the end of supporting higher arms and weights.

We claim:

1. A pipe bending machine comprising a bending assembly (1) with a matrix (4) and a countermatrix (5), a support arm (2) and a mandrel (3) for positioning a pipe, wherein said arm is pivotedly supported swingingly with respect to the bending assembly through a pivot (6) slideably supported along a stem (7) on a first vertical axis passing through a center of rotation of the matrix and a center of swinging of the countermatrix, so as to automatically position a horizontal axis of a side to be bent in said machine on said first vertical axis so as not to vary a distance between said first vertical axis and the mandrel when positioning said arm.

2. The pipe bending machine according to claim 1, wherein said arm (2) is supported by two links (9, 10), the one fixedly united (17) to the bending assembly, the other one pivoted through a third pivot (12) with said arm, and pivoted with each other through a second pivot (11), and to compensate for the swinging of the second link (10) the third pivot (12) is connected with said arm through means that allow a linear reciprocating and a rotary motion relative to said arm; the fixed link (9) for ensuring stability for the machine.

3. The pipe bending machine according to claim 2, further comprising slot idle stroke stops for the angular stroke of the second link (10), fixable in position in a caliper on said second pivot.

4. The pipe bending machine according to claim 1, further comprising adjustable rollers (13) for aligning the pipe to be bent on said horizontal axis of said arm.

5. The pipe bending machine according to claim 4, wherein said adjustable rollers have a groove shaped in such a manner as to restrict movement of the pipe horizontally and vertically.

* * * * *